United States Patent [19]

Lovas et al.

[11] Patent Number: 4,967,549

[45] Date of Patent: Nov. 6, 1990

[54] DEVICE AND PROCESS FOR THE STORAGE OF A YARN

[75] Inventors: Kurt Lovas, Boehmfeld; Wolfgang Gebhardt, Koesching; Heinz Leipnitz, Ingolstadt, all of Fed. Rep. of Germany

[73] Assignee: Schubert & Salzer Maschinenfabrik Aktiengesellschaft, Ingolstadt, Fed. Rep. of Germany

[21] Appl. No.: 384,963

[22] Filed: Jul. 25, 1989

[30] Foreign Application Priority Data

Jul. 26, 1988 [DE] Fed. Rep. of Germany ..... 3825327

[51] Int. Cl.[5] ..... D01H 4/48; D01H 15/00

[52] U.S. Cl. ..... 57/263; 57/261; 242/35.5 R; 242/37 A

[58] Field of Search ..... 57/261–263, 57/328; 242/35.5 R, 35.5 A, 37 A

[56] References Cited

U.S. PATENT DOCUMENTS

| | | | |
|---|---|---|---|
| 4,121,409 | 10/1978 | Uchida et al. | 57/328 X |
| 4,223,518 | 9/1980 | Karl et al. | 57/263 |
| 4,356,692 | 11/1982 | Karl et al. | 57/263 |
| 4,456,188 | 6/1984 | Sakai et al. | 57/261 X |

FOREIGN PATENT DOCUMENTS

| | | |
|---|---|---|
| 1574431 | 6/1971 | Fed. Rep. of Germany . |
| 2255486 | 5/1973 | Fed. Rep. of Germany . |
| 2802913 | 11/1978 | Fed. Rep. of Germany . |

*Primary Examiner*—John Petrakes

*Attorney, Agent, or Firm*—Dority & Manning

[57] ABSTRACT

A device for the storage of a yarn of limited length spun on a spinning machine, comprising a suction pipe and a yarn storage chamber. The suction pipe is connected to a negative-pressure line and serves to seize the yarn by means of suction air. The yarn storage chamber is located between the negative pressure line and the suction pipe. The yarn can be aspirated into the yarn storage chamber and can be drawn off once more in the direction opposite to the direction of aspiration. The yarn storage chamber is located in a body which is rotatably mounted.

In the process for the storing of the yarn, the yarn is seized by the stream of suction air and is sucked through the suction pipe into the yarn storage chamber. The yarn is accumulated against the screen surface of the yarn storage chamber until the stream of suction air in the suction pipe is weakened to a point where additional aspiration of more yarn is prevented. The yarn is then drawn out of the yarn storage chamber through the suction pipe in a direction opposite to the direction of yarn aspiration.

19 Claims, 3 Drawing Sheets

DEVICE AND PROCESS FOR THE STORAGE OF A YARN

BACKGROUND OF THE INVENTION

The instant invention relates to a storage device and to a process for the storage of a limited length of yarn spun on a spinning machine, with a suction pipe connected to a negative-pressure line to seize and guide the yarn by means of suction air, and with a yarn storage chamber located between the negative-pressure line and the suction pipe, into which the yarn can be aspirated, and from which it can again be drawn off in a direction opposite to the direction of aspiration, as well as for the cleaning of the device and for keeping the suction air stream from the suction pipe.

Yarn storage devices of known types are used with yarn processing machines such as winding machines, weaving machines, or spinning machines with high yarn draw-off speed, for example, such as is the case with rotor, friction or air spinning machines. These spinning machines require yarn storage during piecing or repair of a yarn breakage, which is capable of holding a great length of yarn. During the period of preparation of piecing or yarn breakage repair, a great length of yarn is produced which must be stored in intermediate storage.

The storage of the yarn must be made in the smallest possible space since only limited room is available on the spinning unit or in the piecing carriage. In storing the yarn, provisions must be made to ensure that the yarn can be drawn off again at the required point in time easily and free of kinks and without yarn breakage. Yarn breakage during the draw-off process occurs if the friction at the wall of the yarn storage chamber becomes too great, or when tangled yarn layers have formed and hinder the drawing-off of the yarn, due to excessive layers and the formation of snarls.

Known yarn storage devices consist of suction pipes which seize the yarn by means of the suction air stream and draw it into the suction pipes (see German Patent No. DE-AS 2,802,913). Here, the suction pipe must have the same length as the yarn to be stored. Bends in this suction pipe, which would considerably reduce space requirements, have a detrimental influence upon the retention power exerted upon the yarn and increase the previously mentioned danger of yarn breakage.

In yarn storage devices made in form of a screen (German Patent No. 2,255,486, German OS No. 1,574,431), the screen surfaces must be cleaned very often because the screen openings become clogged with fibers and other impurities. As the screen surface becomes more and more dirty, the suction surface decreases and a constant storage capacity is no longer ensured in the yarn storage device after yarn storage.

It is a further disadvantage of yarn storage by means of screens of conventional design, that when a yarn breakage occurs in the yarn storage device, the broken yarn end is seized by the suction air stream and is sucked against the screen surface. This results in clogging up the screen surface so that a further piecing process can only be carried out following a time-consuming cleaning process.

SUMMARY OF THE INVENTION

It is, therefore, the object of the instant invention to create a process and device by means of which a yarn of greater length can be received in a small space, easily and without the disadvantages described above, and can again be drawn off in the direction opposite to the direction in which it was received, without any interference.

This object is attained, according to the invention, in that the yarn storage chamber is located in a body which is rotatably mounted.

By placing the yarn storage chamber in a body which is rotatably mounted, the advantage is achieved that the yarn storage chamber can be subjected to suction in different directions from a suction pipe. This makes it possible to remove impurities or yarn remnants, which are no longer to be used, from the yarn storage chamber, so that the storage capacity of the yarn storage chamber is not affected. In addition, this advantage is obtained in a simple manner, that the yarn, which can no longer be grasped mechanically, for example at one of its end at least, can now be removed from the yarn storage chamber by pneumatic means. The yarn to be stored can always be stored on a cleaned collecting surface, thus decreasing the damage, on the one hand, and making it possible to store essentially the same yarn length with each storage process, on the other hand.

If the yarn storage chamber is widened in the manner of a cone, strong suction is obtained through the intake opening which is small, compared to the surface of deposit. The storage surface in the yarn storage chamber is advantageously at the bottom of the conical yarn storage chamber. Thus, a large surface, on which a great length of yarn can be stored, is made available. If the yarn storage chamber is defined at one end by a screen surface, this ensures that the yarn is deposited in an orderly manner on the screen surface. The yarn is stored on the screen surface until the screen surface is completely covered so that consequently no suction air any longer aspirates the yarn. If the yarn storage chamber is defined by a screen surface at its conically widened end, a great length of yarn is storable, since a large storage surface is available. A yarn end as well as a yarn loop can be stored on the storage surface.

An orderly deposit of the yarn on the screen surface, without danger of tangling the yarn, is achieved by means of openings in the screen surface, the cross-sectional area of which is smaller or equal to the cross-sectional area of the yarn. If the openings were larger than the yarn cross-section, yarn loops would form through the openings of the screen surface, and this could cause damage to the yarn as it is removed from the yarn store.

By rotating the body, the screen surface can be moved from a storage position in to a cleaning position. This leads to the advantage that the screen surface can be subjected to aspiration from different directions without having to move or disconnect the suction pipe. The storage side of the screen surface is capable of being subjected to aspiration from the bottom as well as from the top. This causes yarn remnants and impurities to be removed from the screen surface in the cleaning position, and to be sucked away through the suction pipe.

A suitable design of the body enables the body to receive the storage chamber as well as a locking element for the suction pipe. By rotating the body into a locking position, the suction air can be shut off in the suction pipe. The body then lies completely against a sealing surface and thus shuts off the connection between suction pipe and negative-pressure line.

If the rotatably mounted body can be arrested in at least one of the positions for storage, cleaning, or locking, the reliable execution of that particular function of the body is ensured. If the suction air flows at least in the storage position through the yarn storage chamber into the negative-pressure line. This ensures that the yarn to be stored is sucked only into the yarn storage chamber. A deposit of the yarn outside the yarn storage chamber, possibly due to misdirected air which would flow laterally alongside the body, can thus be avoided. The suction air flows only through the yarn storage chamber and not laterally alongside the outer surface of the body into the negative-pressure line.

If the suction pipe extends as far as directly in front of the body, this ensures that the yarn is guided directly from the suction pipe into the yarn storage chamber. Lateral deposit of the yarn outside the yarn storage chamber is thus avoided.

By designing the yarn storage chamber in such a manner that the suction air flows through the yarn storage chamber without eddies when the body is in the storage position, an orderly depositing of the yarn in the yarn storage chamber is achieved. The formation of eddies in the yarn storage chamber would create the danger that unintended loops may be formed before deposit on the storage surface, whereby orderly draw-off of the yarn from the storage chamber could lead to damage to the yarn or to yarn breakage.

According to the invention, the yarn is seized by the stream of suction air for storage, is sucked through the suction pipe into the yarn storage chamber and is accumulated against a collecting surface of the yarn storage chamber. If the stream of suction air is weakened by the yarn layer accumulating against the collecting surface, further aspiration of additional yarn is gradually prevented. Following the storage process, the yarn is drawn off from the suction pipe and the yarn storage chamber through the suction pipe, in a direction opposite to that of the yarn aspiration. This results in the advantage that the yarn is stored on a very small surface. Furthermore, the length of the yarn to be stored is determined by the size of the collecting surface subjected to suction. Therefore, no additional device which would prevent aspiration of the yarn after a certain yarn length has been reached is necessary.

If a rotatably mounted body containing the yarn storage chamber is rotated so that the yarn storage chamber is subjected to the stream of suction air in a direction opposite to the direction of yarn aspiration, this causes the yarn storage chamber and the collecting surface to be cleaned of yarn remnants and impurities. The collecting surface is subjected to suction from behind through the rotation of the body, whereby the yarn remnants and impurities detach themselves from the collecting surface and are sucked away. The next storage process on the collecting surface, therefore, takes place again on a cleaned collecting surface, and this ensures that each storage process has the same receiving capacity after a cleaning process.

If the rotatably mounted body is rotated so that the stream of suction air is interrupted in the suction pipe, energy is saved since the aspiration is limited to the storage and cleaning process. Furthermore, no additional devices to shut off the suction air stream are needed.

BRIEF DESCRIPTION OF THE DRAWINGS

The invention is described in greater detail below through an embodiment illustrated in the drawings, in which.

DETAILED DESCRIPTION OF THE INVENTION

Figure 1:
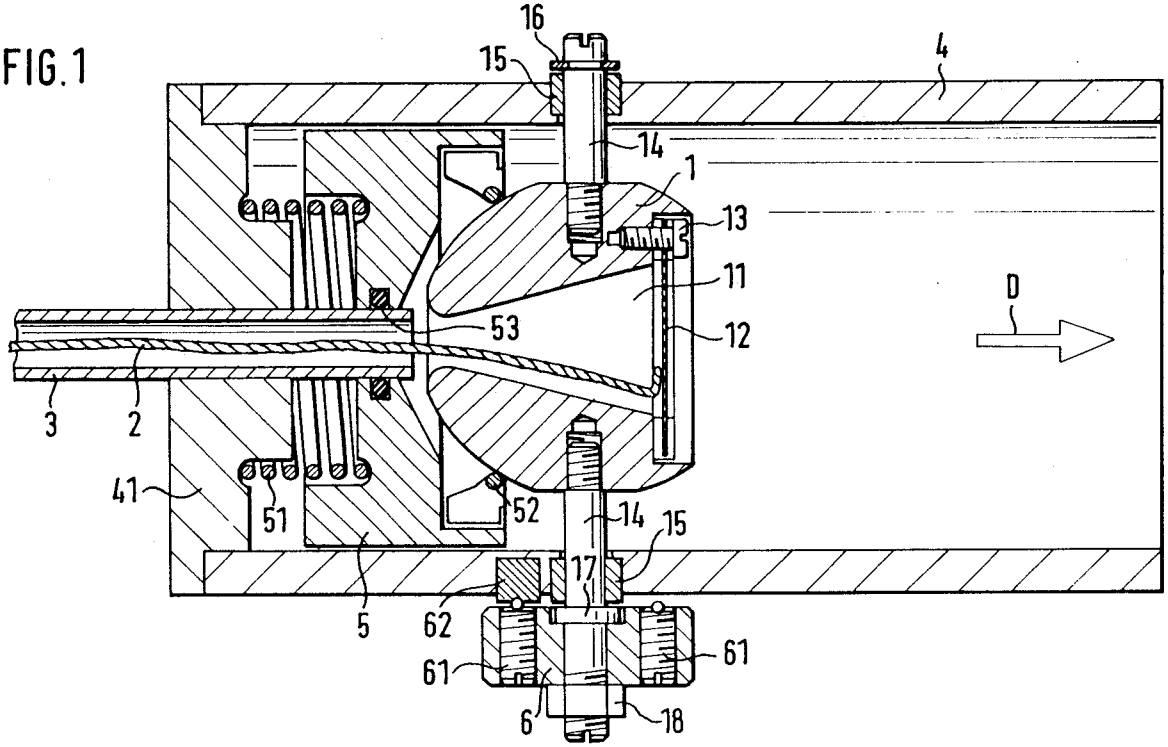
FIG. 1 shows a sectional view through the storage device of the invention during the aspiration of a yarn.

The position of the yarn storage chamber 11 shown in FIG. 1, which is located within a rotatably supported body 1, causes a yarn 2, arriving into the range of the outlet of the suction pipe 3 to be aspirated through the suction pipe 3 into the yarn storage chamber 11 when sufficiently strong negative pressure prevails in the suction pipe 3, in the yarn storage chamber 11 and in the negative-pressure line 4. At the same time, a flow of air takes place through the yarn storage chamber 11 in the longitudinal sense of the outlet of the yarn storage chamber 11 towards a screen surface 12. The yarn 2 accumulates on the screen surface 12 which limits the yarn storage chamber 11 in the direction D of the air flow-through until said screen surface 12 is completely covered by the yarn 2. The size of the screen surface 12 controls the length of yarn to be stored. The larger the screen surface 12, the more yarn 2 can be stored, since a large quantity of yarn is necessary in order to produce a sealing yarn layer on the screen surface 12. If the yarn layer is so thick that the negative pressure in the suction pipe 3 is no longer sufficient to aspirate the yarn 2, the yarn accumulation is ended automatically. Essentially, the yarn 2 to be stored is stored in one layer on the screen surface 12. The screen surface 12 is located at the largest cross-sectional are of the conically configured yarn storage chamber 11.

The conically configured yarn storage chamber 11 creates a connection between the screen surface 12 and the suction pipe 3. The suction pipe 3 has a considerably smaller cross-sectional area than the screen surface 12. This produces a great suction force in the suction pipe 3, so that the grasping and aspiration of the yarn 2, from a bobbin for example, is facilitated. The end of the suction pipe 3, near the rotatably supported body 1 is located in immediate proximity of the turned-away intake opening of the yarn storage chamber 11. This prevents yarn 2 from accidentally entering the space between suction pipe 3 and body 1 and from breaking as it is drawn out of the chamber. This is, furthermore, seconded through the fact that a flow of suction air must constantly flow through the screen surface 12 and the yarn storage chamber 11, since the rotatably supported body 1 and the suction pipe 3 are sealed off by packings 52, 53 from the negative-pressure line 4.

The packings 52, 53 are attached in a supporting device 5 which is mounted so as to be movable in one direction. The supporting device 5, together with packing 52, is pressed against body 1 by a spring 51 which bears against the cover 41 of the negative-pressure line 4, whereby the packing 52 prevents lateral entry of suction air into the yarn storage chamber 11. The packing 53 prevents entry of suction air between supporting device 5 and suction pipe 3.

The body 1 is connected to a rotatable axle 14. The direction of the airflow D of the suction air through the yarn storage chamber runs essentially at a right angle to axle 14 in the storage position shown in FIG. 1. The screen surface 12 is parallel to axle 14 and is connected to the body 1 by means of screws 13.

The axles 14 of the rotatably supported body 1 are mounted in bearings 15 in the housing of the negative-pressure line 4. The bearings 15 must have a considerable sealing effect against the outside so that pressure losses may be kept down.

A hand wheel 6 provided with three ball pressure pins or detents 61, used as stops, of which, however, only two are shown in FIG. 1, is connected to the axle 14. The ball pressure pins 61 catch in a recess of a catch element 62 and stop and hold the rotatably mounted body 1 in three different positions. The ball pressure pins 61 can be adjusted for intensity of pressure so that secure stopping of the body 1 in each of the three positions is ensured. The three stop positions are essentially the positions of the rotatably mounted body 1 as shown in FIGS. 1, 2 and 3.

In another embodiment (not shown), the rotatably mounted body 1 is not actuated by means of a hand wheel 6 but is driven by a motor or pneumatic drive element. Here the ball pressure pins 61 and the catch element 62 can be dispensed with, since in this case the drive elements can be controlled up to the positions shown in FIGS. 1, 2 and 3, so that no external stopping assistance is required. Another possibility for the drive is actuation via a lever system. In this way the position of the rotatably supported body 1 can be controlled at another location than directly at the negative-pressure circuit 5, e.g., from a traveling piecing automat. Basically, any drive element can be considered to be suitable if it is able to assume different operational positions, also with the help of gearings, and to hold the body 1 in the pertinent positions for a certain period of time.

The hand wheel 6 is pressed by means of a nut 18 against a ring collar 17 and is thus attached to the axle 14. The axle 14, to which the hand wheel 6 is attached, is secured against accidental axial shifting by means of a safety ring 16.

Figure 2:
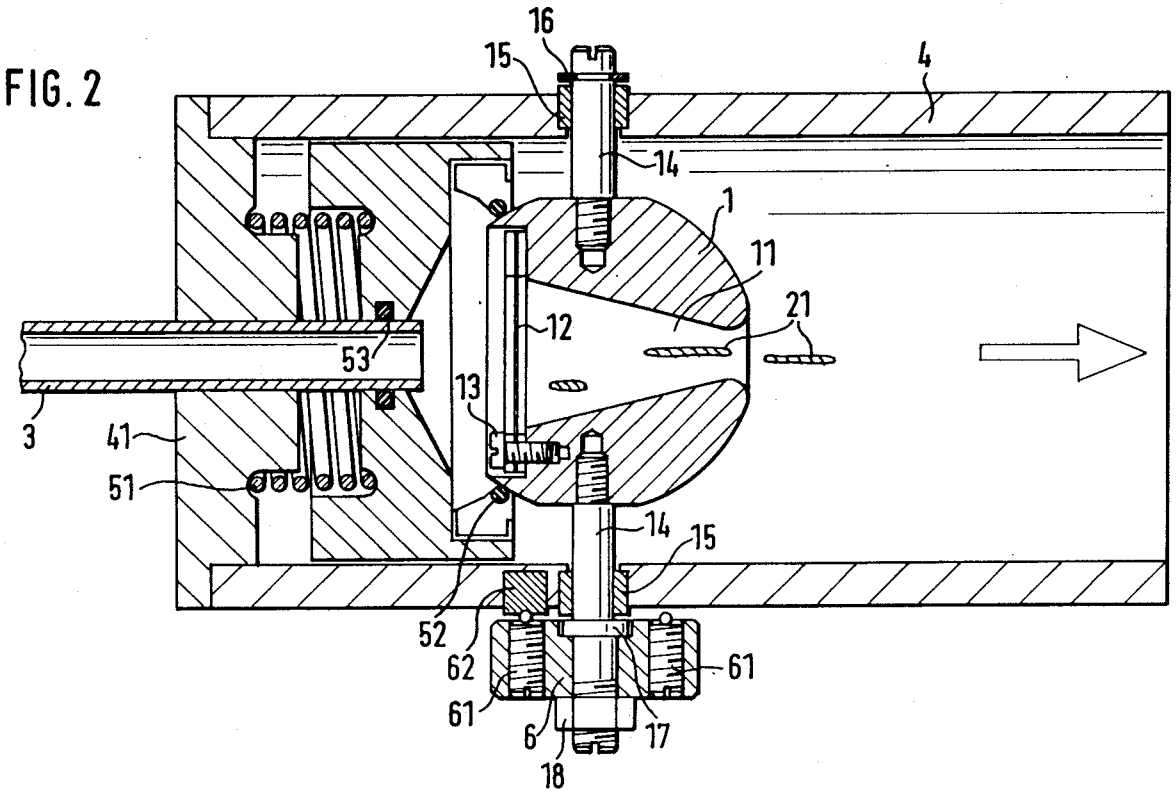
FIG. 2 shows a sectional view through the storage device of the invention during cleaning of the yarn storage chamber.
Figure 3:
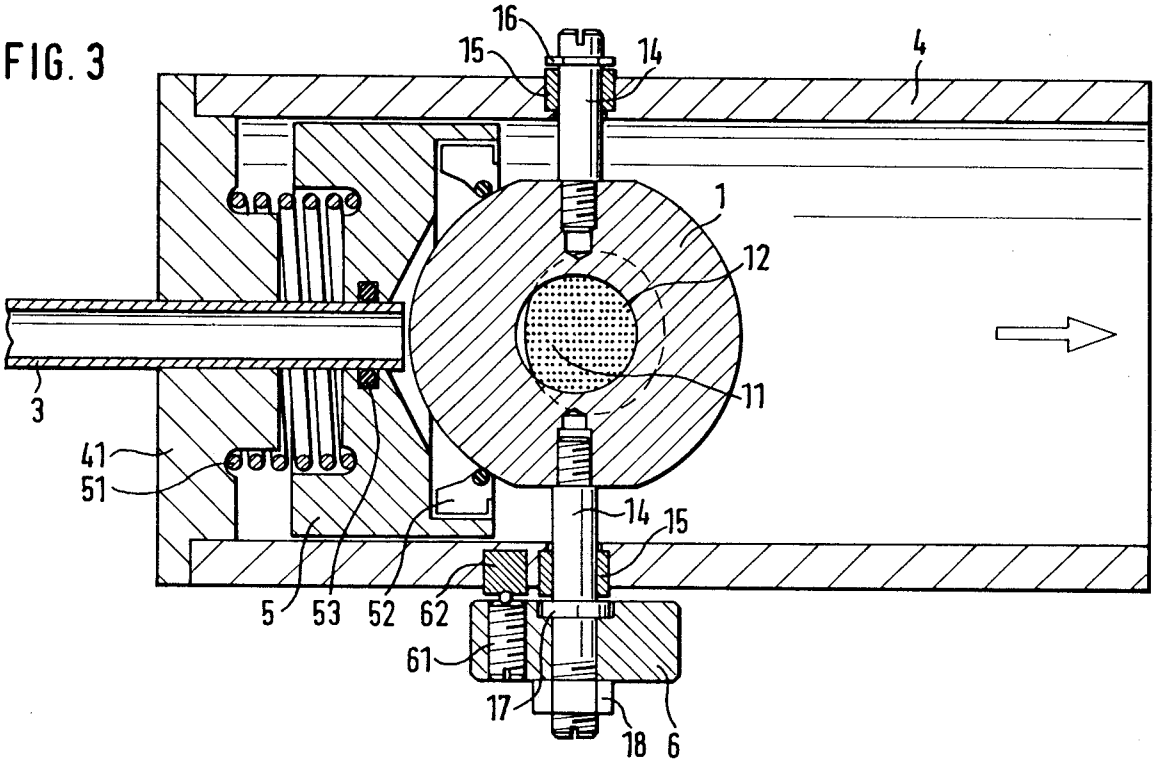
FIG. 3 shows a sectional view through the storage device in which the suction pipe is separated from the negative-pressure line.

FIG. 2 shows the position of the yarn storage chamber 11 in which the screen surface 12 and the yarn storage chamber 11 are cleaned. The flow-through direction D in the yarn storage chamber 11 and through the screen surface 12 is opposite to the flow-through direction D of the position shown in FIG. 1, so that yarn remnants and impurities 21 are separated from the screen surface 12 and are sucked into the negative-pressure line 4. From here they go into known, and therefore not shown, filters or waste containers.

In this position, too, the packing 52 acts upon the rotatably mounted body 1 so that the screen surface 12 is subjected to suction only from one side, just as in the position of FIG. 1. This ensures that the yarn remnants and impurities 21 can be separated rapidly from the screen surface 12, since they are subjected to great suction force.

FIG. 3 shows the locking position of the yarn storage chamber 11, in which the suction pipe 3 is sealed off from the suction air stream. The packing 52 encloses the rotatably mounted body 1 in such manner that no suction connection is established between the suction pipe 3 and the negative-pressure line 4 by the yarn storage chamber 11 and the screen surface 12. The yarn storage chamber 11 and the screen surface 12 are located on the side of the negative-pressure line 4 in the embodiment shown.

If the rotatably mounted body 1 is in such a position, between the positions shown in FIG. 2 and in FIG. 3, so that the screen surface 12 or the outlet of the yarn storage chamber 11 takes such a course across the packing 53 that a direct connection exists between the suction channel 3 and the negative-pressure line 4, yarn remnants and impurities 21 which have accumulated in the space between suction pipe 3 and the rotatably mounted body 1 are removed.

The form of the rotatably mounted body 1 is not limited to the form of the embodiment shown. It must, however, be adapted to the packing 52 and to the axle 14 in such manner that the packing 52 adheres closely to the body 1, at least in the storage position and in the locking position.

The yarn storage chamber 11 must be configured in such manner that the suction air flowing through is sufficiently strong in the storage position to be able to seize the yarn but without producing any eddies in the yarn storage chamber 11. The suction air must flow effectively close to the sides of the walls. This prevents curling of, or damage to, the yarn 2 to be stored, or yarn breakage during draw-off. Therefore, yarn storage chambers 11 of other shapes than the one shown, permitting eddy-free flow-through with sufficient suction force can be utilized. The configuration of the outlet opening as well as the widening of the chamber cross-section in relation to its length are determining factors for an eddy-free air flow through the yarn storage chamber 11. If the yarn storage chamber 11 is widened too much, i.e., if the angle between the tangent to the wall of the yarn storage chamber 11 and the flow-through direction is too great, the airflow can no longer flow close to the walls and thus produces eddies which can take hold of the yarn 2 and influence it negatively in the manner described above.

The screen surface 12 must ensure that the yarn 2 can be deposited in an orderly manner on the screen surface 12 and can be drawn off subsequently without being damaged. If the screen surface 12 is not flat, as in the embodiment of the example, but is vaulted, it becomes possible to store an even greater length of yarn without enlarging the space of the device, if the screen surface is not necessarily enlarged by the rotatably mounted body 1 as a result. It is, of course, also possible to attach the screen surface by means of clamps, adhesive or other types of bonding to the body 1, instead of using the screw connection illustrated.

The above-described device operates as follows:

The yarn 2 to be stored is seized by the suction air stream acting at the end of the suction pipe 3 and is sucked through the suction pipe 3 into the yarn storage chamber 11 which is stopped in the position shown in FIG. 1. The aspirated yarn 2 is accumulated against the screen surface 12 of the yarn storage chamber 11 and, in the process, decreases the effective suction surface more and more. The yarn layer building up in front of the screen surface 12 reduces the suction air stream in the suction pipe 3 and also gradually reduces the force of the air flow which is required to aspirate additional yarn 2.

As soon as the suction air stream is reduced in the suction pipe 3 to the point that further aspiration of additional yarn 2 is no longer possible, the stored yarn quantity remains constant until the yarn 2 is drawn from the suction pipe 3 and from the yarn storage chamber 11. The direction of draw-off is here opposite to the storage direction of the yarn.

Upon emptying the yarns from the yarn storage chamber 11, the rotatably mounted body 1 in which the yarn storage chamber 11 is located, is rotated so that the yarn storage chamber 11 and the screen surface 12 are subjected to air flow in a direction opposite to the direction of storage. At the same time, remaining yarn remnants and impurities 21 are removed from the screen surface 12 and from the yarn storage chamber 11.

To remove easily removable impurities 21 it is possible for the rotatably mounted body 1 not to be stopped or held in that position but to be moved through this position slowly. If this is sufficient to clean the screen surface, the device is simplified in the sense that only two ball pressure pine 61 or two stop positions according to FIGS. 1 and 2 are needed.

Stubborn dirt can, however, only be removed by stopping the rotatably mounted body 1 in the cleaning position in which it must remain until the screen surface 12 has been cleaned.

When the yarn storage chamber 11 and the screen surface 12 have been cleaned, the rotatably mounted body 1 is rotated into a position in which it keeps the suction air stream prevailing in the negative-pressure line 4 from the suction pipe 3 until yarn storage is to be carried out once more.

This process ensures, in a simple manner, that a yarn end of a determined length can be stored and delivered subsequently and that the yarn storage chamber 11 is again ready for use after a brief cleaning period. If the yarn storage chamber 11 is not needed, the suction air stream can be shut off and energy can be saved without requiring any additional devices.

We claim:

1. A storage device for storing a length of yarn on a yarn processing machine, comprising:

(a) a negative-pressure line;

(b) a suction pipe for receiving and guiding said yarn;

(c) a yarn storage chamber having a screen extending across one end of said chamber disposed between said suction pipe and said negative-pressure line in fluid communication with said suction pipe and negative-pressure line in a position where air is drawn through said screen in one direction when yarn is stored in said chamber;

(d) means to support said storage chamber for movement between a storage position and a screen cleaning position wherein air is drawn through said screen and said storage chamber in the opposite direction to remove any fibers or yarn residue contained therein; and (e) means for moving said storage chamber from said yarn storing position to said screen cleaning position.

2. A storage device as set forth in claim 1, wherein said storage chamber has a conical shape.

3. A yarn storage device as set forth in claim 2, wherein said screen extends across said conical storage chamber at its widest point.

4. A storage device as set forth in claim 3, wherein said screen extends across the base of said conical storage chamber.

5. A yarn storage device as set forth in claim 1, wherein said screen has openings with a cross-sectional area which is not greater than the cross-sectional area of the yarn to be stored therein.

6. A yarn storage device as set forth in claim 1, wherein said storage chamber is mounted for rotation between said storage position and said screen cleaning position.

7. A storage device as set forth in claim 1, wherein said storage chamber is supported for movement to a fluid blocking position between said storage position and said screen cleaning position for blocking fluid communication between said suction pipe and said negative-pressure line.

8. A yarn storage device as set forth in claim 7 including means to lock said storage chamber in said fluid blocking position.

9. A process for storing a length of yarn on a yarn processing machine in a storage chamber having a screen wall, comprising the following steps:

(a) drawing said length of yarn and air into said storage chamber in a first direction to cause said yarn to accumulate on said screen;

(b) stopping the movement of said yarn and air into said storage chamber when a predetermined length of yarn is accumulated in said storage chamber;

(c) withdrawing said yarn from said storage chamber in a second direction opposite to said first direction; and (d) purging and cleaning said storage chamber and said screen by causing air to move through said storage chamber and said screen in a direction opposite to said first direction.

10. A process as set forth in claim 9, including the step of moving said storage chamber into a position wherein said air moves through said storage chamber and screen in said opposite direction.

11. A process as set forth in claim 9, including the step of continuously drawing air into, and through, said storage chamber and said screen.

12. A process as set forth in claim 9, including the step of interrupting the flow of air through said storage chamber and said screen after said yarn is withdrawn from said storage chamber.

13. A storage device for storing a length of yarn on a yarn processing machine, comprising:

(a) a negative-pressure line;

(b) a suction pipe for receiving and guiding said yarn;

(c) a body mounted between said negative-pressure line and said suction pipe;

(d) a yarn storage chamber disposed in said body between said negative-pressure line and and said suction pipe in fluid communication with said negative-pressure line and said suction pipe and having a screen surface as one wall of said chamber;

(e) means supporting said body for moving said body to a plurality of positions;

(f) means for securing said body and said storage chamber in a first position in fluid communication with said negative-pressure line and said suction pipe for receiving and storing a length of yarn in said chamber, and in a second position in fluid communication with said negative-pressure line and said suction pipe for purging and cleaning said chamber; and (g) means for moving said body and said storage chamber from said first position to said second position.

14. A storage device as set forth in claim 13, wherein said yarn storage chamber is conically shaped.

15. A storage device as set forth in claim 14, wherein said screen extends across the base of said conically shaped storage chamber.

16. A storage device as set forth in claim 13, wherein said screen is provided with a plurality of openings which have a cross-sectional area that is not greater than the cross-sectional area of yarn to be stored therein.

17. A storage device as set forth in claim 13, wherein said body is supported for rotation between said plurality of positions.

18. A storage device as set forth in claim 13, including means for locking said body in at least one of said plurality of positions.

19. A storage device as set forth in claim 18, wherein said locking means includes means to lock said body in each of said plurality of positions.

* * * * *